US009144837B2

(12) United States Patent
Roessler et al.

(10) Patent No.: US 9,144,837 B2
(45) Date of Patent: Sep. 29, 2015

(54) ROLLING TOOL, APPARATUS AND METHOD FOR THE PRODUCTION OF CROWNED TEETH, AND GEAR

(75) Inventors: Horst Roessler, Wels (AT); Juergen Buchinger, Gmunden (AT); Robert Spitaler, Bad Wimsbach/Neydharting (AT); Christian Sandner, Gmunden (AT)

(73) Assignee: Miba Sinter Austria GmbH, Laakirchen (AT)

( * ) Notice: Subject to any disclaimer, the term of this patent is extended or adjusted under 35 U.S.C. 154(b) by 695 days.

(21) Appl. No.: 13/508,805

(22) PCT Filed: Nov. 9, 2010

(86) PCT No.: PCT/AT2010/000431

§ 371 (c)(1),
(2), (4) Date: Aug. 1, 2012

(87) PCT Pub. No.: WO2011/057311

PCT Pub. Date: May 19, 2011

(65) Prior Publication Data

US 2012/0297623 A1 Nov. 29, 2012

(30) Foreign Application Priority Data

Nov. 10, 2009 (AT) ..... A 1776/2009

(51) Int. Cl.

| | |
|---|---|
| ***B21K 1/30*** | (2006.01) |
| ***B23P 15/14*** | (2006.01) |
| ***B21H 5/02*** | (2006.01) |

(52) U.S. Cl.

CPC ..... *B21H 5/02* (2013.01); *B21H 5/022* (2013.01); *Y10T 29/49471* (2015.01)

(58) Field of Classification Search

USPC ..... 29/893, 893.3, 893.32; 72/80, 109, 110, 72/112, 212

See application file for complete search history.

(56) References Cited

U.S. PATENT DOCUMENTS

| | | | | |
|---|---|---|---|---|
| 3,584,488 | A | 6/1971 | Erdelyi | |
| 3,884,063 | A * | 5/1975 | Tersch | 72/102 |
| 4,414,729 | A | 11/1983 | Ridley | |
| 4,575,289 | A | 3/1986 | Fischer et al. | |
| 6,289,586 | B1 | 9/2001 | Casella et al. | |
| 6,517,772 | B1 | 2/2003 | Woolf | |
| 2008/0201950 | A1 | 8/2008 | Beigang | |
| 2010/0064755 | A1 | 3/2010 | Koller et al. | |

FOREIGN PATENT DOCUMENTS

| | | |
|---|---|---|
| CH | 564 999 | 8/1975 |
| CN | 1416975 A | 5/2003 |

(Continued)

OTHER PUBLICATIONS

International Search Report of PCT/AT2010/000431, Jun. 1, 2011.

*Primary Examiner* — Richard Chang
(74) *Attorney, Agent, or Firm* — Collard & Roe, P.C.

(57) ABSTRACT

The invention relates to a rolling tool (2) for producing crowned teeth on a gear (5) using a transverse rolling process, in particular for compressing the teeth of the gear (5) at least in some areas, comprising a tool body (6) which has tool teeth (7) projecting radially outward for meshing with the teeth of the gear (5) to be rolled, wherein at least some areas of the tool teeth (7) are concave in the axial direction in the area of the tooth flanks.

14 Claims, 3 Drawing Sheets

(56) References Cited

FOREIGN PATENT DOCUMENTS

| | | | |
|---|---|---|---|
| CN | 101267901 | A | 9/2008 |
| DE | 18 17 649 | | 7/1970 |
| DE | 2 004 222 | | 9/1970 |
| DE | 16 52 654 | | 4/1971 |
| DE | 19 66 067 | | 4/1971 |
| DE | 2 060 579 | | 6/1972 |
| DE | 27 14 706 | | 10/1978 |
| DE | 29 48 106 | | 6/1981 |
| DE | 32 19 674 | | 12/1982 |
| FR | 2 385 480 | | 10/1978 |
| GB | 1 265 987 | | 3/1972 |
| GB | 2 146 560 | | 4/1985 |
| JP | 09-70634 | A | 3/1997 |
| JP | 2003-145243 | A | 5/2003 |
| JP | 2008-049384 | | 3/2008 |
| WO | WO 92/05897 | | 4/1992 |
| WO | WO 2008/116243 | | 10/2008 |

* cited by examiner

ROLLING TOOL, APPARATUS AND METHOD FOR THE PRODUCTION OF CROWNED TEETH, AND GEAR

CROSS REFERENCE TO RELATED APPLICATIONS

This application is the National Stage of PCT/AT2010/000431 filed on Nov. 9, 2010, which claims priority under 35 U.S.C. §119 of Austrian Application No. A 1776/2009 filed on Nov. 10, 2009, the disclosure of which is incorporated by reference. The international application under PCT article 21(2) was not published in English.

The invention relates to a rolling tool for producing crowned teeth on a gear using a transverse rolling process, in particular for compressing the teeth of the gear at least in some areas, comprising a tool body, which has tool teeth projecting radially outward for meshing with the teeth of the gear to be rolled, a device for rolling the teeth of a gear, in particular for compressing the teeth of the gear at least in some areas, comprising two gear-like rolling tools for meshing with the teeth of the gear, wherein the rolling tools are held respectively in a holding device and are each arranged on a rolling spindle, a method for compressing the teeth of a gear at least in some areas by transversely rolling the teeth with the meshing of the teeth of a tool toothing of two rolling tools, and a gear comprising a spur toothing with teeth, wherein the teeth in the region of the tooth flanks have a broad crowning with a convex curvature extending in axial direction.

To achieve optimum running properties for running gears it is usual to apply toothing modifications in the form of arc-like crowning over the width of the toothing. In general it is known that crowned teeth can be used to avoid disadvantageous contact patterns, such as for example edge carriers, where the contact area of the flanks is only effective in the edge area of the toothing, which can lead to locally increased pressure on the contact areas. Furthermore, edge carriers can cause the toothing to be noisy in a disadvantageous manner. An additional advantage of crowned teeth is that misalignments in the parallelism of the axles on which the running wheels are mounted can be compensated.

Broad crowning can be applied for example during the hard fine finishing of the toothing, for example by grinding or polishing. If the hard fine finishing stage is omitted because the toothing only needs to comply with lower quality requirements, it would be an advantage to apply the broad crowning during the production of the toothing prior to heat treatment.

From DE 1 652 654 A a method is known for crown rolling the toothing of gears, according to which the axis of the workpiece in relation to the rolling tool on the one hand performs a rotational movement about the rolling axis and on the other hand performs a wobbling movement of the rolling axis along the path of a cone, the tip of which lies in the rolling axis, whereby the rotational speed of the workpiece about the rolling axis and the speed of the additional wobbling movement differ from another. The workpiece is clamped between two lathe centers for performing the method, which are positioned eccentrically in relation to the rolling axis on the casings of two cones, the tip of which lies in the rolling axis. After completing the main shaping procedure the pivotably mounted roller head with the size of the desired crowning can be pivoted in one or more directions from its neutral position on the rolling axis. It is thus possible to produce a radial crowning of the toothing or a longitudinal crowning, i.e. an axial crowning of the toothing. The disadvantage is that an additional wobbling movement is performed, which means that precision toothings are difficult to produce or cannot be produced at all in this way.

From DE 2 060 579 A gear-like rolling tool is known for the non-chipping fine processing of pretoothed tooth flanks of gears with internal or external toothing, in particular of spur gears or bevel gears, by shaping by means of a pressing force leading to surface pressing between the tooth flanks of the tool and the workpiece. The rolling tool itself has crowned toothing in order to create a relatively small contact area, in order to be able to achieve the necessary surface pressure with a small, external pressing force. The formation of broad crowning on a gear is not described therein however.

From DE 32 19 674 A1 a gear rack-like tool is known for cold-rolling a crown toothing, comprising a tool carrier and a tool insert mounted thereon. The latter comprises a toothing produced by linear grinding and curving of the tool insert, the tooth shape of which is complementary to the tooth shape of crowned toothing. The tool insert can be produced in such a way that on a flat, plate-like insert blank with flat main surfaces a toothing is produced with straight teeth by linear grinding and then the insert is attached to the gear rack so that when working with the tool the desired shape of tooth is achieved which is complementary to the crowned toothing. It is a disadvantage here that the tool can only be used in certain conditions during the continual production process of a gear and that by means of the necessary bends in the tool insert on the one hand it is difficult to obtain a toothing with low tolerances and on the other hand the tool insert itself suffers continual bending stress, even if the tool has elastic properties.

The objective of the invention is to make it possible to produce a broad crowned toothing on a gear.

According to the invention this is achieved by the aforementioned rolling tool, in which the tool teeth are designed to have concave crowning in the region of the tooth flanks in axial direction, at least in some parts, and independently thereof by means of a rolling tool, in which the tool body in axial direction has a compression area and a separate area for producing the crowning on the toothing of the gear, and independently thereof by means of the aforementioned device in which the roller spindles and/or at least a portion of the holding devices are designed to be pivotable, and independently thereof by means of the method in which the compression is performed with rolling tools according to the invention or by means of a device according to the invention for rolling the toothing of a gear, and by means of a gear, in which the broad crowning follows a progressive path of the radius of curvature, wherein the radius of curvature beginning from a crown area of the curvature becomes larger up to the area of transition with the front faces of the gear.

By means of the concave crown design of the tooth flanks of the tool teeth, i.e. by means of their concave inwardly curved surfaces, it is possible to apply the broad crowning to the gear to be produced during the compression process of sintered gears by transverse rolling, so that the process for producing the broad crowning has a neutral cycle time. In this case any curved shapes are possible for the crowning, for example circular arc shapes, segmented forms of circular arcs and lines etc. It is also an advantage that the whole tooth, that is the tooth base, the tooth flank, and the tooth crest are rolled, so that a standard finish quality can be achieved for the finished gear. Thus the formation of the broad crowning can be omitted during the so-called hard fine processing or in a separate procedure. Thereby, so-called "net shape" teeth can be obtained without post-processing with good running properties. By designing the rolling tool with a separate compression area the production of the tool can be simplified. In addition, in this way the rolling time is barely extended or only by a negligible amount. It is also an advantage that if there is a break in the compression area of the tool the expensive rolling tool for producing the crowning can continue to be used. The latter is particularly expensive as such tools are usually produced by grinding using CNC profile grinding machines. This type of tool is also suitable for producing broad crowning on the tooth flanks on obliquely toothed gears, in that the gear to be produced is secured to be non-displaceable in axial direction.

By means of the device according to the invention for rolling gears the geometry of the crowning can also be adjusted by the degree of turning, in addition the formation of broad crowning during roller is also possible without complex rolling tools, so that conventional cylindrical rolling tools known from the prior art can also be used. Also in this embodiment variant of the invention the broad crowning can be achieved in the compression process of sintered gears by transverse rolling, whereby again a neutral cycle time is achieved.

In general the advantage is that any curved shapes can be produced relatively simply by means of rolling. For example, the shape of the crowning in addition to the aforementioned shapes can also perform polynomial functions. It is thus possible to have progressive crowning, for example the curvature can be increased towards the edge of the toothing, i.e. towards the front faces of the gears. This has the particular advantage that with a small load almost the entire width of the tooth is in contact with the mating gear. If the load is then increased the progressive form increases the contact area by a negligible amount, but prevents very efficiently the edge of the gear becoming the contact area and prevents a so-called edge carrier being formed. As the edge is non-linear, the avoidance of edge carriers improves the noise production levels of the gear.

By way of explanation it should be noted that the term broad crowning is defined as crowning in the axial direction of the teeth of a gear.

The concave crown area can have at least two different radii of curvature in radial direction in order to obtain a better contact pattern for the gear.

According to one embodiment variant of the rolling tool a plurality of concave crown areas are arranged behind one another on the tooth flanks in axial direction. By having a multitrack rolling tool it is possible to work several gears simultaneously. Furthermore, it is thereby possible with a single gear to perform different processing steps for processing the toothing with only one rolling tool.

It is an advantage in this case if a web is formed between two adjacent areas. In this way the directional stability can be improved when rolling the toothing of several gears.

At least two of the plurality of concave crown sections can have different concave curvatures from one another in axial direction, whereby the broad crowning of the toothing of the gear can have a greater precision with respect to its geometry, as processing in several individual steps allows a lower degree of shaping.

In particular, the succession of varyingly concave curved crown sections is configured such that the radius of curvature of the concave crown increases between the individual processing stages, so that in successive areas material can be moved to the edge area, i.e. the border area, the transition between the front face and the toothing of the gear, thereby increasing the strength of the border section.

At least two of the plurality of concave crown areas can differ at least in the crown area of the concave curvature with respect to their diameter. In this way the compression process can be adjusted more effectively. In particular, the variation in diameter is such that the diameter of the rolling tool in the crown area of the concave crown sections can be increased from one area to the next by compressions in this area. It is also possible however that exactly in reverse the diameter reduces from one area to the next, so that a relaxation area is formed between two individual compression steps, before an area with a larger diameter follows and thereby higher densities can be achieved at least in the surface area of the toothing of the gear.

According to one embodiment variant of the rolling tool in which the compression area is separate from the shaping area for forming the crowning of the toothing of the gear to be produced, the two areas are separated from one another by a third area, which has a smaller diameter than the two adjoining sections. This intermediate area supports the "threading" during the transfer of the gear from the compression tool into the area of the shaping tool, whereby this transfer can be performed more smoothly and more gently for the gear, that is more gently for the toothing to be produced.

It is also possible in this variant of the invention for the compression area to be multi-tracked and to have a width in axial direction, which is a multiple of the width of the gear to be compressed in the same direction. In this way at the same time several gears, i.e. the teeth of the gear wheels, can be compressed so that the load factor of the area for shaping the broad crowning can be increased, which is a particular advantage as this shaping allows a shorter cycle time than the compression process. In addition, it is also possible to devise the compression process in several stages, whereby the gear changes successively from one track to the other track by simple sliding, where here too variations are possible with relaxation areas or variants with increasing diameters of the compression tool.

Furthermore, it is also possible with this rolling tool that the area for producing the crowning on the toothing of the gear is configured according to the aforementioned embodiments and variants of the invention and in addition the aforementioned advantages can be transferred accordingly.

It is also possible that in the device according to the invention for rolling the teeth of a gear the rolling tools are designed according to the aforementioned embodiment variants of the invention.

For a better understanding of the invention the latter is explained in more detail with reference to the following figures.

Figure 1:
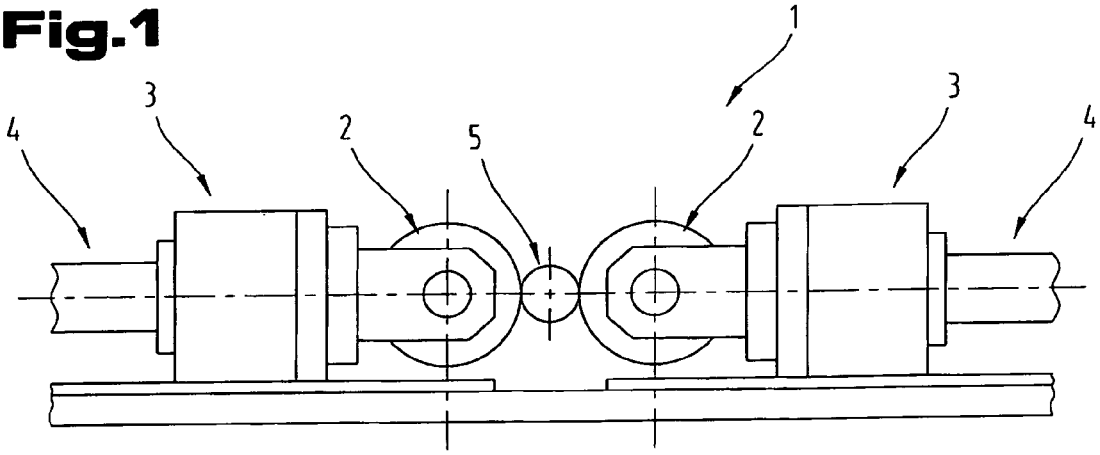
FIG. 1 shows a cross section of a rolling device for gears in side view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a cross section of a device 1 for rolling the toothing of a gear, as known from the prior art. This device 1 comprises two gear-like rolling tools 2, which are each held rotatably in a holding device 3, in particular a roller slide. Said holding devices 3 are arranged respectively on their own slide spindles 4.

The rolling tools 2, that is their teeth, mesh with the teeth of a gear 5 to be produced. The gear 5 itself is preferably made from a sintered material in a sintering method and already has the rough outline of a toothing.

During the rolling process the rolling tools 2 and the gear 5 rotate, where at least one of the rolling tools 2 can be driven. However, it is also possible for both rolling tools 2 to be driven, or it is possible for the second rolling tool 2 to be a follower, and for the drive of the first rolling tool 2 to be transferred via the gear 5 to said rolling tool 2. It is also possible for the gear 5 to be driven itself and for the two rolling tools 2 to be simply followers.

Figure 2:
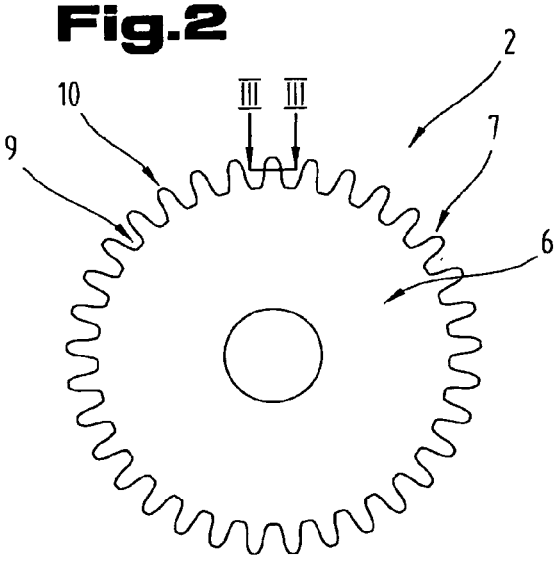
FIG. 2 shows a rolling tool according to a first embodiment variant of the invention.

FIG. 2 shows one of the rolling tools 2 in side view. Said rolling tool 2 consists of a tool body 6, which has radially outward projecting tool teeth 7 for meshing with the toothing of the gear 5 to be rolled (FIG. 1).

Figure 3:
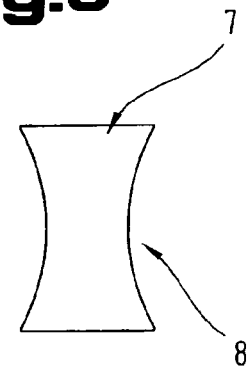
FIG. 3 shows a cross section of a tooth of the rolling tool according to FIG. 2 in cross section along III-III of FIG. 2.

As shown in FIG. 3, which shows a cross section of a tool tooth 7 according to the cross section III-III of FIG. 2, said tool tooth 7 is configured to be in the form of a concave crown with an inwardly pointing concave curvature 8. This curvature 8 is complementary to the convex curvature of the crown of the tooth flanks of the toothing of the gear 5 to be produced. Preferably, this concave crowning extends from a tooth base 9 to a tooth crest 10 of the tool toothing of the rolling tool 2 (FIG. 2). It is thereby possible by using transverse rolling to achieve the crowning of the tooth flanks in the gear 5 to produced, and at the same time compress the sintered gear, and thereby depending on the curvature 8 bring about the displacement of material and thereby a compression of preferred areas, for example the edge areas, of the toothing of the gear 5, i.e. in the area of transition from the front sides to the tooth flanks.

The concave crowning, i.e. the curvature 8, can have various different geometric forms. In the simplest case the latter is designed to be in the form of an arc, as shown in FIG. 3. It is also possible however for the curvature 8 to consist of different areas, for example areas with different radii of curvature. These sections with different radii of curvature can be interrupted by straight areas.

Furthermore, it is possible in general to design the concave crowning to have different radii of curvature over the course of the curvature, in order to produce gear wheels 5 that have a better contact pattern or it is possible to compensate for imprecisions in the tooth flanks. For example, the curvature in the central area of the tooth flanks can have a greater radius of curvature than in at least one of the two edge areas of the tooth flanks or vice versa. Also finer graduations are possible with more than two different radii of curvature.

Figure 4:
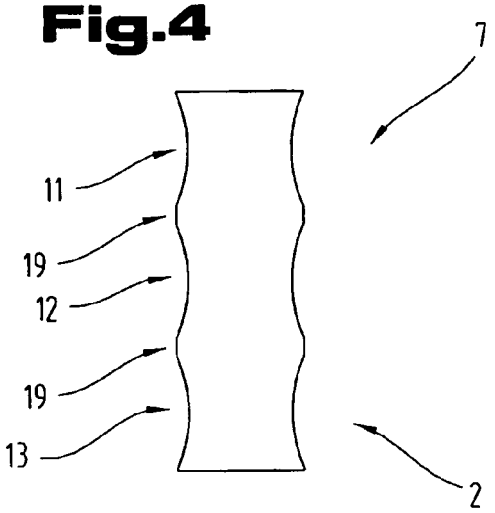
FIG. 4 shows a plan view of a cross section of a tool tooth of one embodiment variant of the rolling tool according to the invention.

FIG. 4 shows a cross section of a tool tooth 7 of one embodiment variant of a rolling tool 2 according to the invention. Said tool tooth 7 is divided into three sections 11 to 13 whereby three tracks are formed. It is thus possible to work three gear wheels 5 (FIG. 1) at the same time in a rolling process for producing crowning in the tooth flank are.

Of course, more than three such areas 11 to 13 can be arranged on the rolling tool 2.

Figure 5:
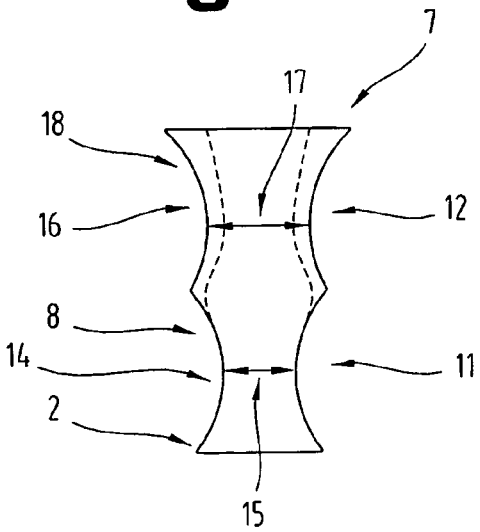
FIG. 5 shows a plan view of a cross section of a tool tooth of a further embodiment variant of the invention.

Furthermore, it is thereby possible, as shown in FIG. 5, which also shows a tooth 7 in cross section and plan view of an embodiment variant of the rolling tool 2, for these sections 11, 12 on the rolling tool 2 to be configured to be different. For example, as shown, section 11 in a crown area 14 of the curvature 8 can have a smaller diameter 15 than a crown area 16, which in this case has a diameter 17 which is greater than diameter 15. It is thereby possible to expose the compression and/or formation of the crowning in the region of the tooth flanks of the gear 5 (FIG. 1) to different, consecutive processing steps, for example as shown in FIG. 5, to perform a two-step compression, in that in a first compression step the gear 5 is rolled transversely in section 11 and in a second compression step with further compression in section 12.

Furthermore, it is possible, as indicated by dashed lines in FIG. 5, for the two sections 11, 12 to differ with respect to their curvature 8, i.e. the radius of curvature, whereby in section 11 the curvature 8 has a smaller radius than the curvature 18 of section 12. It is also possible in this embodiment variant for the two curvatures 8, 18 not to be circular arc-like as shown, but for the latter to have different geometric shapes, for example different radii of curvature within at least one of the curvatures 8, 18 etc., as described above.

Of course, it is also possible within the scope of the invention for the sections 11, 12 to be reversed, so that the gear 5 (FIG. 1) firstly runs through the section 12 with the larger diameter, in that there is a corresponding compression and shaping, after which the gear 5 runs through area 11, whereby in this section 11 because of the smaller diameter 15, compared to the diameter 17 of section 12, the relaxation of the compression zone is possible, and a further section follows, which is not shown in FIG. 5, which has a larger diameter than diameter 15 and thereby a subsequent compression step is performed, whereby this diameter can also be greater than the diameter 17 of section 12.

As also shown in FIG. 5, sections 11 to 13 can be separated from one another by webs 19.

Figure 6:
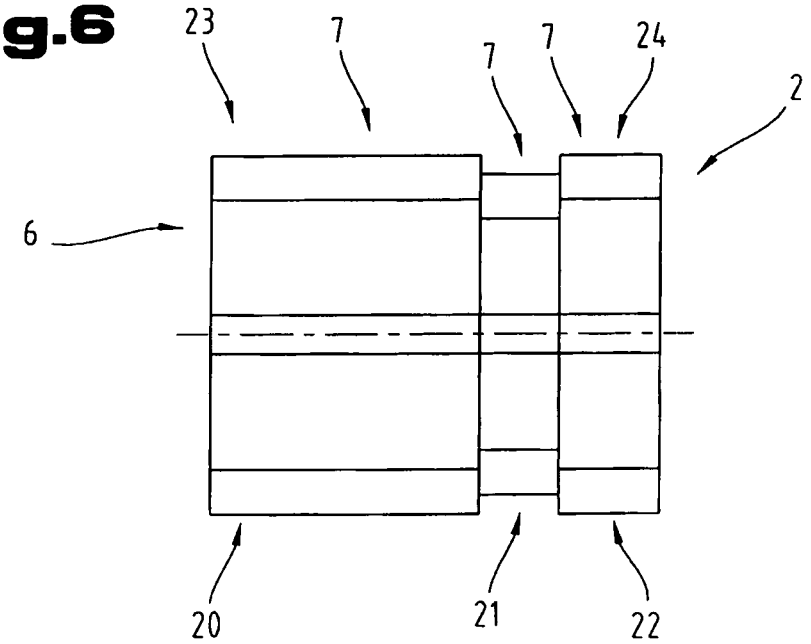
FIG. 6 shows a rolling tool with separate areas for compressing and shaping the crowning.

FIG. 6 shows an embodiment variant of the rolling tool 2, in which said rolling tool is designed in three parts, with a first part 20, a second middle part 21 and a third part 22, which adjoins the second part 21. Part 20 is configured as a compression area 23, in which only the compression of the gear 5 (FIG. 1) takes place in the region of the teeth, i.e. the tooth bases and/or tooth flanks and/or tooth crests. By means of the middle part, which has a smaller diameter than parts 20 and 22, the transfer of the meshing gear 5 during the operation of the device 1 (FIG. 1), i.e. with running rolling tools 2, from the compression area 23 of part 20 to part 22 is facilitated. Part 22 in turn forms a section 24 of the rolling tool 2, in which finally the broad crowning of the teeth of the toothing of the gear 5 (FIG. 1) is performed.

In one embodiment variant it is also possible for this middle part 21 to be left out, so that the compression area 23 directly adjoins the section 24 for producing the crowning. All of the parts, i.e. parts 20 to 22 or 20 and 22, support the tool toothing with the tool teeth 7 projecting externally radially on the tool body 6.

The tool part 22, i.e. its tool teeth 7, can be configured as described above.

It is also possible, although the multipart form is preferred for the above reasons, for said rolling tool 2 according to FIG. 6 to be designed in one piece.

It is also possible for the compression area 23 to have more than one track, so that a plurality of gears 5 (FIG. 1) can undergo the tooth compression process at the same time.

Figure 7:
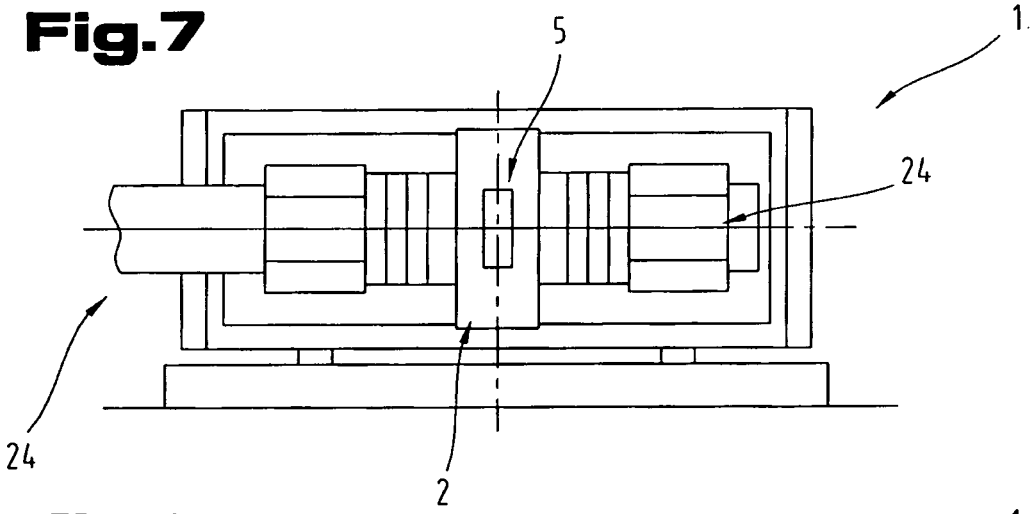
FIG. 7 shows an embodiment variant of a rolling device in neutral position.
Figure 8:
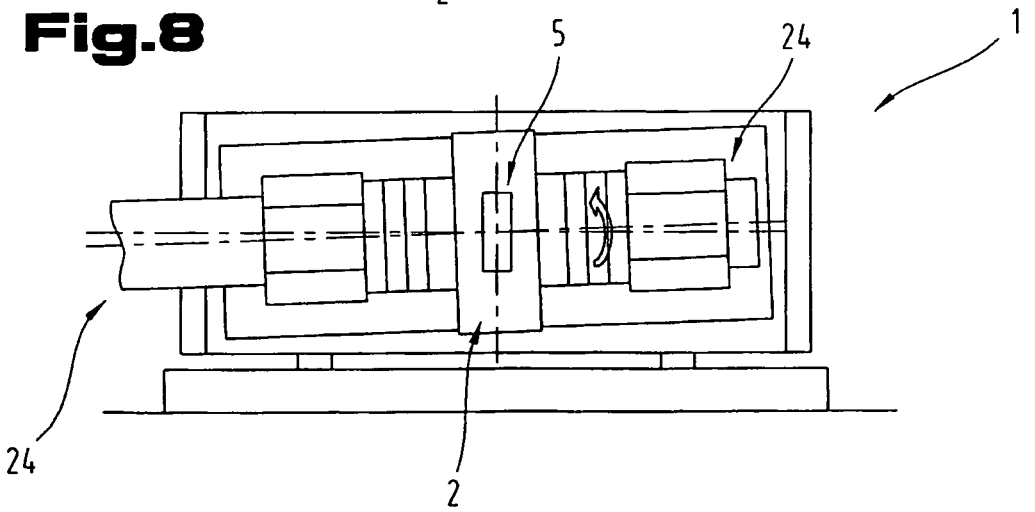
FIG. 8 shows the rolling device according to FIG. 7 with pivoted roller spindle.

FIGS. 7 and 8 show a first embodiment variant of the device 1 according to the invention for rolling the toothing and producing a broad crowning of the gear 5. Here roller spindles 24, on which the rolling tools 2 are arranged, are pivoted from the neutral position shown in FIG. 7, in which the axes of said roller spindles 24 and the axis of the gear 5 are aligned to be colinear, about an angle in a vertical plane, as shown in FIG. 8, so that this co-linearity no longer exists between the axes. The gear 5 remains unchanged with respect to its axis. The rolling tools 2 are pivoted as well at the same time as the roller spindles 24, as shown in FIG. 8. In this way over the pivoting area a different curvature of the broad crowning of the toothing of the gear 5 can be achieved. The pivot range can be for example up to 12°, in particular between 0° and 9°.

Figure 9:
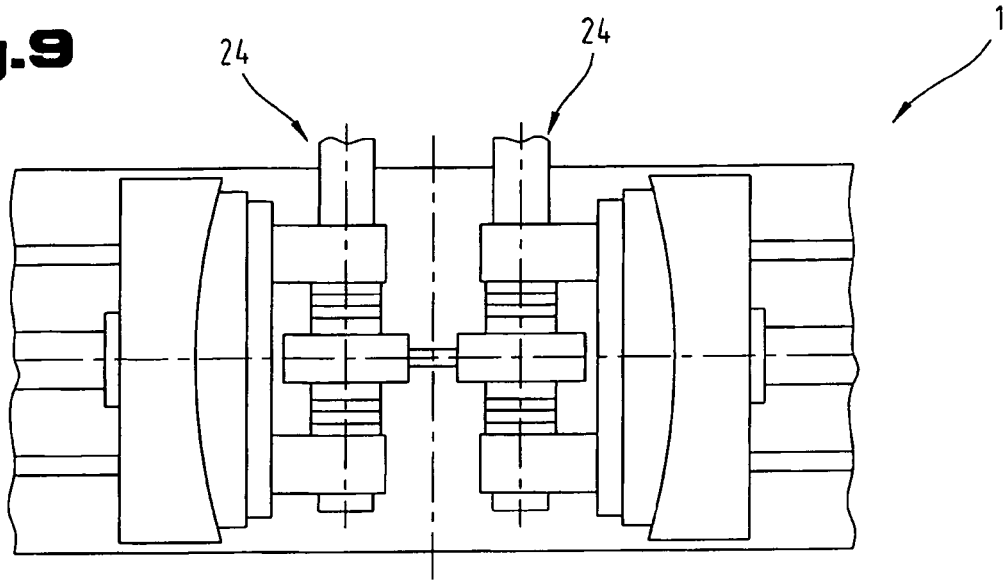
FIG. 9 shows an embodiment variant of a rolling device in neutral position.
Figure 10:
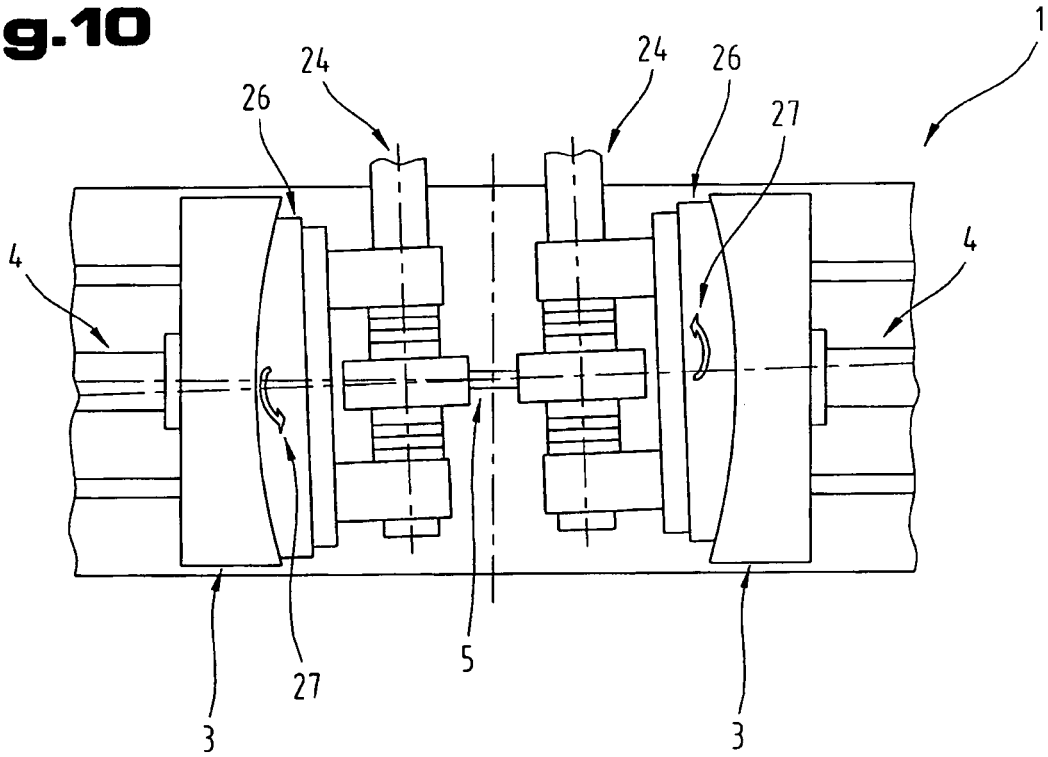
FIG. 10 shows the rolling device according to FIG. 9 with pivoted roller slide.

Alternatively or in addition to this pivoting of the roller spindles 24, FIGS. 9 and 10 show an embodiment variant of the device 1, in which the holding devices 3 are configured to have multiple parts and comprise roller slides 26, which can be pivoted in the holding devices 3 according to arrows 27 from the neutral position into a position (FIG. 10) pivoted in a horizontal plane (FIG. 10). The roller spindles 24 themselves are thereby also pivoted in this plane in relation to the axis of the gear 5, which remains unchanged. Also by means of this embodiment variant a corresponding broad crowning of the teeth of the toothing of the gear 5 can be achieved, wherein the extent of this broad crowning can be adjusted by the adjusting angle of the roller slide 26 in relation to the neutral position (FIG. 9). The two roller slides 26 have convex surfaces on their rear side facing away from the gear 5, which can slide off concave surfaces of the tool holder of the holding device 3 for pivoting. A suitable spindle drive or the like can of course also be provided.

Also combinations of both variants are possible, so that the roller spindles 25 can be pivoted both in a horizontal and in a vertical plane.

Figure 11:
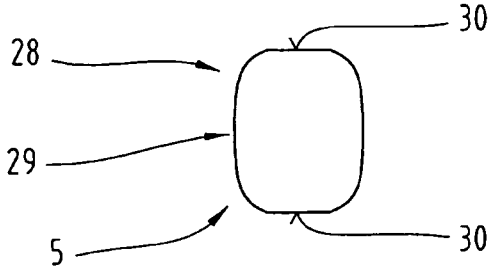
FIG. 11 shows a cross section of a tooth of a gear according to the invention in plan view.

Lastly, in FIG. 11 a cross section of a tooth 28 of the toothing of the gear 5 is shown, wherein said tooth 28 has the broad crowning and said broad crowning follows a progressive path, whereby from a crown area 29 in the direction of front faces 30 the radius of curvature of the crowning increases, whereby the aforementioned effects can be achieved.

Here a plurality of curvature paths for the broad crowning are also possible, so that the curvature can increase step by step or continually in the direction of the face surfaces 30, starting from the crown area 29.

The exemplary embodiments show possible embodiment variants of the device 1 and the rolling tool 2, whereby it should be noted at this point that the invention is not restricted to the embodiment variants shown in particular, but rather various different combinations of the individual embodiment variants are also possible and this variability on the basis of the teaching on technical procedure of the present invention would lie within the competence of a person skilled in this technical field.

Finally, as a point of formality, it should be noted that for a better understanding of the structure of the device 1 and the rolling tool 2 the latter and its components have not been represented true to scale in part and/or have been enlarged and/or reduced in size.

List of Reference Numerals

1 Device
2 Rolling tool
3 Holding device
4 Slide spindle
5 Gear
6 Tool body
7 Tool tooth
8 Curvature
9 Tooth base
10 Tooth crest
11 Section
12 Section
13 Section
14 Crown area
15 Diameter
16 Crown area
17 Diameter
18 Curvature
19 Web
20 Part
21 Part
22 Part
23 Compression area
24 Roller spindle
25 Section
26 Roller slide
27 Arrow
28 Tooth
29 Crown area
30 Face surface

The invention claimed is:

1. A rolling tool for producing a crowned toothing on a gear using a transverse rolling process and for compressing teeth of the gear, the rolling tool comprising a tool body configured to rotate about an axis and having tool teeth projecting radially outward for meshing with the teeth of the gear to be rolled, each tool tooth of the tool teeth having a respective tooth flank extending in an axial direction, wherein each tooth flank comprises a plurality of sections arranged behind one another in the axial direction, each section of the plurality of sections having a respective concave crowning, and wherein a first section of the plurality of sections has at least two different radii of curvature in a radial direction.

2. The rolling tool as claimed in claim 1, wherein a web is formed between two adjacent sections of the plurality of sections.

3. A rolling tool for producing a crowned toothing on a gear using a transverse rolling process and for compressing teeth of the gear, the rolling tool comprising a tool body configured to rotate about an axis and having tool teeth projecting radially outward for meshing with the teeth of the gear to be rolled, wherein the tool body has a compression area and a separate section for producing the crowning on the teeth of the gear, the compression area extending in an axial direction and having a compression area diameter, and the separate section extending in the axial direction and having a separate section diameter, and wherein a third section is disposed between the compression area and the separate section so that the compression area and the separate section are spaced separated from each other in the axial direction, the third section having a third section diameter smaller than the compression area diameter and smaller than the separate section diameter.

4. The rolling tool as claimed in claim 3, wherein the compression area is configured to be multi-tracked.

5. The rolling tool as claimed in claim 3, wherein first teeth of the tool teeth are disposed in the separate section, wherein each first tooth of the first teeth has a respective tooth flank extending in the axial direction, and wherein each tooth flank has a concave crowning.

6. The rolling tool as claimed in claim 5, wherein each tooth flank of the first teeth comprises a plurality of sections arranged behind one another in the axial direction, and wherein each section of the plurality of sections has a respective concave crowning.

7. The rolling tool as claimed in claim 6, wherein a web is formed between two adjacent sections of the plurality of sections.

8. The rolling tool as claimed in claim 6, wherein a first section of the plurality of sections has a first concave curvature, and wherein a second section of the plurality of sections has a second concave curvature different from the first concave curvature.

9. The rolling tool as claimed in claim 6, wherein in a first section of the plurality of sections each first tooth has a first diameter at a base of curvature of the concave crowning of the first section, and wherein in a second section of the plurality of sections each first tooth has a second diameter at a base of curvature of the concave crowning of the second section, the second diameter being greater than the first diameter.

10. A device for rolling teeth of a gear and for compressing the teeth of the gear, the device comprising two gear-like rolling tools for meshing with the teeth of the gear, wherein the rolling tools are held in a respective holding device comprising a respective roller slide on a respective pivotable rolling spindle, wherein the holding devices are also each arranged on a respective slide spindle, wherein the device is configured so that pivoting of the pivotable rolling spindles is performed by pivoting of the slide spindles and/or by pivoting of the roller slides, wherein the roller slides have rear sides facing away from an opposing rolling tool of the two gear-like rolling tools and have respective convex surfaces on the rear sides, and wherein the device is configured so that the convex surfaces slide off on concave surfaces of the tool holder of the holding device for pivoting.

11. The device as claimed in claim 10, wherein the two gear-like rolling tools are configured for producing a crowned toothing on a gear using a transverse rolling process and for compressing teeth of the gear, each rolling tool of the two gear-like rolling tools comprising a respective tool body configured to rotate about an axis and having tool teeth projecting radially outward for meshing with the teeth of the gear to be rolled, each tool tooth of the tool teeth having a respective tooth flank extending in an axial direction, and wherein each tooth flank comprises a plurality of sections arranged behind one another in the axial direction, each section of the plurality of sections having a respective concave crowning.

12. A method for compressing teeth of a gear, the method comprising steps of:

providing two rolling tools, each rolling tool comprising a tool body configured to rotate about an axis and having tool teeth projecting radially outward for meshing with the teeth of the gear to be rolled, each tool tooth of the tool teeth having a respective tooth flank extending in an axial direction, each tooth flank comprising a plurality of sections-arranged behind one another in the axial direction, each section of the plurality of sections having a respective concave crowning, a first section of the plurality of sections having a first concave curvature, and a second section of the plurality of sections having a second concave curvature different from the first concave curvature, placing the gear between the two rolling tools in a position so that the gear engages with the first sections of the two rolling tools, rolling the two rolling tools so that the teeth of the gear are compressed via the first sections, moving the gear so that the gear engages with the second sections of the two rolling tools, and rolling the two rolling tools so that the teeth of the gear are compressed via the second sections.

13. A rolling tool for producing a crowned toothing on a gear using a transverse rolling process and for compressing teeth of the gear, the rolling tool comprising a tool body configured to rotate about an axis and having tool teeth projecting radially outward for meshing with the teeth of the gear to be rolled, each tool tooth of the tool teeth having a respective tooth flank extending in an axial direction, wherein each tooth flank comprises a plurality of sections arranged behind one another in the axial direction, each section of the plurality of sections having a respective concave crowning, wherein a first section of the plurality of sections has a first concave curvature, and wherein a second section of the plurality of sections has a second concave curvature different from the first concave curvature.

14. A rolling tool for producing a crowned toothing on a gear using a transverse rolling process and for compressing teeth of the gear, the rolling tool comprising a tool body configured to rotate about an axis and having tool teeth projecting radially outward for meshing with the teeth of the gear to be rolled, each tool tooth of the tool teeth having a respective tooth flank extending in an axial direction, wherein each tooth flank comprises a plurality of sections arranged behind one another in the axial direction, each section of the plurality of sections having a respective concave crowning, wherein in a first section of the plurality of sections the tooth has a first diameter at a base of curvature of the concave crowning of the first section, and wherein in a second section of the plurality of sections the tooth has a second diameter at a base of curvature of the concave crowning of the second section, the second diameter being greater than the first diameter.

* * * * *